US007958591B1

(12) United States Patent
Rogers

(10) Patent No.: US 7,958,591 B1
(45) Date of Patent: Jun. 14, 2011

(54) CLEANING TOOL WITH TELESCOPING SHAFT AND MANIPULATEABLE, INTERCHANGEABLE CLEANING SURFACES

(76) Inventor: John L. Rogers, Newport News, VA (US)

( * ) Notice: Subject to any disclaimer, the term of this patent is extended or adjusted under 35 U.S.C. 154(b) by 888 days.

(21) Appl. No.: 11/983,166

(22) Filed: Nov. 7, 2007

(51) Int. Cl.
*A47L 4/02* (2006.01)

(52) U.S. Cl. ..... 15/210.1; 15/209.1; 15/147.1; 15/147.2

(58) Field of Classification Search ..... 15/210.1, 15/147.1, 209.1; 401/188; *A47L 4/02*
See application file for complete search history.

(56) References Cited

U.S. PATENT DOCUMENTS 1,777,516 A 10/1930 Castle
2,614,281 A 10/1952 Clark
2,789,307 A 4/1957 Sussman et al.
3,383,158 A 5/1968 Leland
5,337,445 A 8/1994 Harris et al.
5,630,243 A 5/1997 Federico et al.
2006/0123575 A1 6/2006 Maloney et al.
2006/0130259 A1 * 6/2006 Collins ..... 15/220.3
* cited by examiner

*Primary Examiner* — Monica S Carter
*Assistant Examiner* — Stephanie Newton
(74) *Attorney, Agent, or Firm* — David L. Banner

(57) ABSTRACT

A cleaning tool having a cleaning head disposed at the distal and of an elongated, extendable shaft. A handle at the proximal end contains a lever attached to a linkage. The cleaning head has an elbow joint and provides an attachment point for an upper support arm and a lower support arm movable with respect thereto. The elbow joint allows the cleaning head to be rotated with respect to the distal end of the elongated, extendable shaft. Two-sided pads may be attached to distal ends of both the upper arm and the lower arm. Each two-sided pad may have a different cleaning property on each of its two major faces. This allows up to four different cleaning surfaces to be present at the cleaning head of the cleaning tool of the present invention. A linkage is provided between the lever and the lower support arm.

15 Claims, 8 Drawing Sheets

CLEANING TOOL WITH TELESCOPING SHAFT AND MANIPULATEABLE, INTERCHANGEABLE CLEANING SURFACES

FIELD OF THE INVENTION

The invention pertains to cleaning tools and, more particularly, to a cleaning tool with an extendable shaft having a set of jaws selectively movable through an approximately 180° range of motion, each of the jaws being adapted to carry a different cleaning pad.

BACKGROUND OF THE INVENTION

Many cleaning tasks require the manipulation of a cleaning implement such as a brush, a vacuum cleaner attachment, a dusting cloth or pad, etc. to be applied to a surface out of reach of a person attempting to clean that surface. It is well known in the art to provide elongated handles for brushes and the like to allow an operator to clean some out-of-reach surface. Some such handles allow a slight manipulation of the cleaning implement attached to their distal ends. Such tools are generally adequate for cleaning simple surfaces.

Some cleaning tasks, however, require more sophisticated manipulation of the cleaning device than is provided by such simple, elongated handles. One such cleaning project is cleaning the blades of a ceiling fan. Ceiling fan blades typically require cleaning both a lower and an upper surface. In some cases, it is desirable to clean the edges of the fan blades as well. Ceiling fans are often located out of easy reach of the person wishing to clean them.

It is often desirable to clean a surface in more than one step. For example, a person may wish to apply a moistened cloth, sponge, pad, etc. to a surface, and then dry that surface with a different cloth, pad, etc. Using extended handle implements of the prior art, such a two-phase cleaning operation required interchanging a pad, sponge, brush, etc. attached to the handle with a different cleaning implement.

DISCUSSION OF THE RELATED ART

Many attempts have been made to overcome deficiencies of cleaning implements of the prior art. For example, U.S. Pat. No. 1,777,516 for BRUSH, issued Oct. 7, 1930 to Frank E. Castle, discloses a brush foldable at a central point to partially surround an object to be cleaned. A pull ring located near the proximal end of the brush handle serves as an actuator to inwardly fold the brush.

U.S. Pat. No. 2,614,281 for ALLEY SWEEP FOR TEXTILE MILLS, issued Oct. 21, 1952 to Horace E. Clark, shows a broom having two segments movable with respect to one another. A scissor mechanism manipulates the two broom segments.

U.S. Pat. No. 2,789,307 for DEVICES FOR CLEANING VENETIAN BLINDS, issued Apr. 23, 1957 to Sydney Sussman, et al., provides a tool for cleaning venetian blind slats. Pairs of upper and lower pads are movable with respect to one another. This allows cleaning both a top and bottom surface of a blind slat.

U.S. Pat. No. 3,383,158 for TOILET BOWL CLEANER WITH DISPOSABLE SWAB, issued May 14, 1968 to Ragnvald G. Leland, shows a toilet cleaning device wherein upper and lower cleaning surfaces of a pad may be moved outwardly with respect to one another by an actuator located on the apparatus handle.

U.S. Pat. No. 5,337,445 for VACUUM FAN DUSTER, issued Aug. 16, 1994 to Gregory Harris, et al., shows an attachment for a vacuum cleaner that may be slipped over the end of a ceiling fan blade. The attachment may then be slid along the fan blade to facilitate cleaning both upper and lower surfaces thereof.

U.S. Pat. No. 5,630,243 for TOILET CLEANING DEVICE WITH CLEANING PAD, issued May 20, 1997 to Vera L. Federico, et al., discloses a tool having a handle with the trigger at one end and a pair of jaws, one of which is movable, at the other end.

United States Published Patent Application No. 2006/0130259, for WINDOW BLIND CLEANING SYSTEM, published Jun. 22, 2006, upon application by Linda M. Collins, discloses a device having a handle, an extension handle attachable thereto, a trigger mechanism located at one end of the handle, a pair of backing plates movable with respect to one another, and cleaning pads attachable to the backing plates to form cleaning heads. The trigger mechanism moves the backing plates toward one another.

United States Published Patent Application No. 2006/0123575, for ADJUSTABLE HOLDER FOR CLEANING IMPLEMENT, published Jun. 15, 2006, upon application by Michael J. Maloney, et al., discloses a telescoping handle having a distal end adapted to receive a cleaning pad. In one embodiment, the Maloney, et al. apparatus allows two portions of the supporting mechanism at the distal end of the handle to be rotated relative to one another.

None of the patents and published patent applications, taken singly, or in any combination are seen to teach or suggest the novel cleaning tool of the present invention.

SUMMARY OF THE INVENTION

In accordance with the present invention, there is provided a cleaning tool having a cleaning head disposed at the distal end of an elongated, telescoping shaft. A handle region at the proximal end of the elongated, telescoping shaft, contains a lever attached to a linkage. The cleaning head consists of an elbow joint and a lower support arm, movable by the lever and linkage. A fixed, upper support arm is also provided. The distance between the lower support arm and the upper support arm may be adjusted. Each of the lower and upper support arms supports a fork assembly having outer and inner tines onto which replaceable, reversible cleaning pads may be slid. An elbow joint allows the cleaning head to be rotated with respect to the major axis of the elongated, telescoping shaft.

Two-sided pads may be slid onto the outer tines of both the upper arm and lower arm assemblies. Each two-sided pad may have a different cleaning property on each of its two major faces. This allows up to four different cleaning surfaces to be present at the cleaning head of the cleaning tool of the present invention. In addition, a single pad may be folded and slid over the inner tines of the upper and lower fork assembly.

In alternate embodiments of the novel cleaning tool, the elbow joint may provide motion in more than one plane. Because of the unique structure, allowing up to 180° between the upper arm and lower arm, the novel tool is adapted to perform numerous cleaning activities.

In still other embodiments of the novel cleaning tool, a fluid reservoir may be attached to the tool handle. A second lever is provided to actuate a pump for delivering a fluid from a fluid reservoir to a spray head near the movable arms.

It is, therefore, an object of the invention to provide a cleaning tool having an elongated, telescoping shaft.

It is another object of the invention to provide a cleaning tool having a pair of support arms, one support arm being rotatively movable with respect to the other.

It is a further object of the invention to provide a cleaning tool having a pair of support arms, wherein the distance therebetween may be adjusted.

It is an additional object of the invention to provide a cleaning tool, wherein the pair of arms each have a range of motion of approximately 180° with respect to one another.

It is a still further object of the invention to provide a cleaning tool wherein the arms are supported in an arm housing, which is, in turn, attached to an elongated shaft through an elbow joint that allows rotation of the arm housing with respect to the elongated shaft.

It is yet another object of the invention to provide a cleaning tool, wherein each arm supports a two-sided pad.

It is an additional object of the invention to provide a cleaning tool wherein each pad has a different cleaning property on each of its two major surfaces.

It is a further object of the invention to provide a cleaning tool having a self-contained fluid reservoir and a manually actuated pump for delivering a fluid to a cleaning head thereof.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a cleaning tool having a cleaning head disposed at the distal end of an elongated, extendable shaft. A handle region at the proximal end of the elongated, telescoping shaft, contains a lever attached to a linkage. A lower elbow joint is mounted at the distal end of telescoping shaft. A cleaning head having an adjustable length shaft member movably connected to lower elbow joint extends outwardly therefrom. A second elbow joint is disposed at an outer, distal end of the adjustable length shaft member and supports an upper fork support arm that is pivotally attached thereto. The arm housing provides an attachment point for an upper arm and a lower arm movable with respect to one another. The elbow joint allows the arm housing to be rotated with respect to the distal end of the elongated, extendable shaft. Two-sided pads may be attached to distal ends of both the upper and the lower arms. Each two-sided pad may have a different cleaning property on each of its two major faces. This allows up to four different cleaning surfaces to be present at the cleaning head of the cleaning tool of the present invention. In still another embodiment of the cleaning tool, a detachable fluid reservoir is provided adjacent the handle. A second lever is adapted to pump fluid from the reservoir to a nozzle at the cleaning head.

Figure 1A:
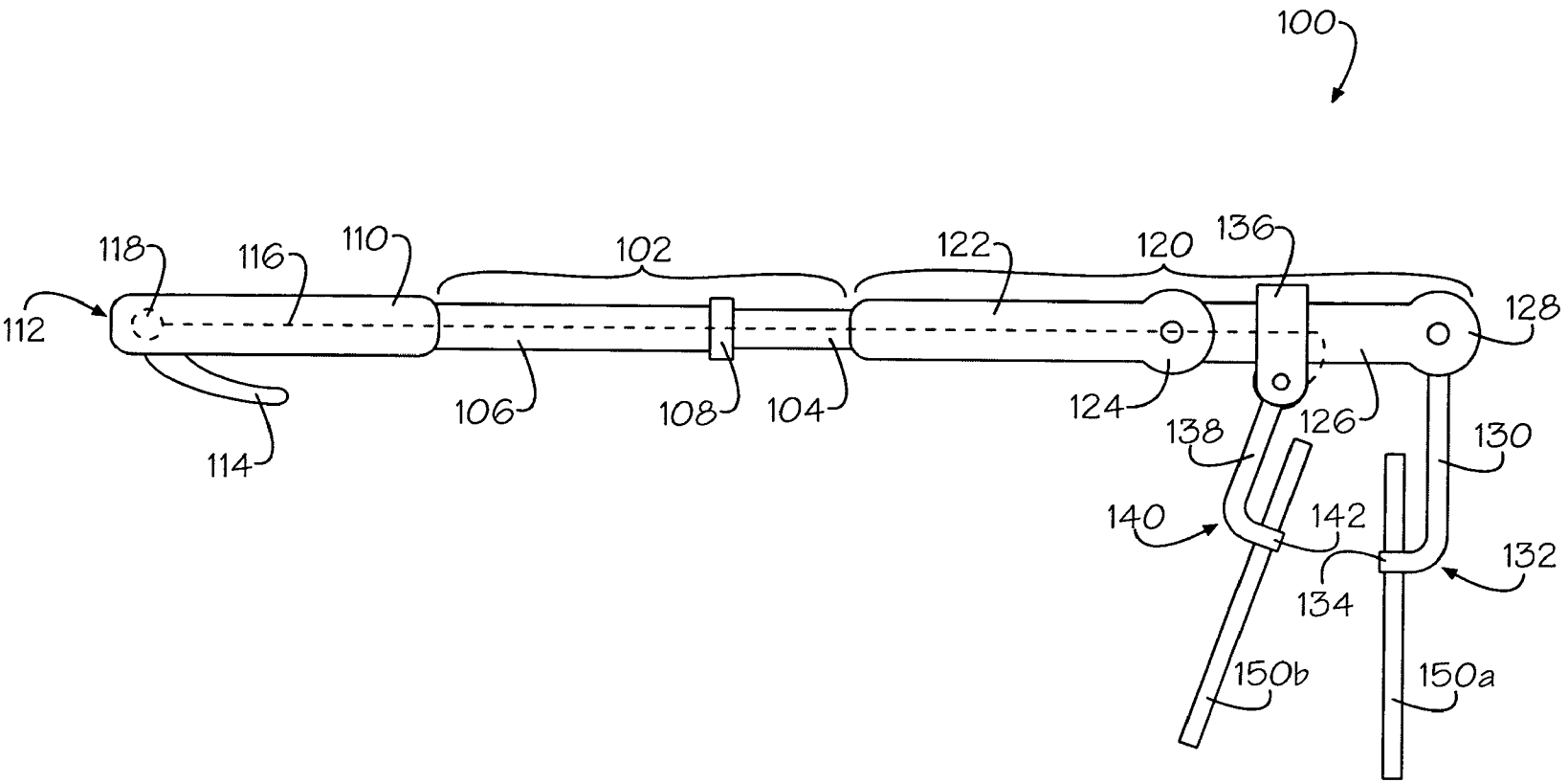
FIG. 1*a* is a plan, schematic view of the cleaning tool in accordance with the invention.

Referring first to FIG. 1*a*, there is shown a plan, schematic view of a first embodiment of the cleaning tool of the present invention, generally at reference number 100. An elongated, telescoping shaft 102 consists of an inner shaft portion 104 and an outer shaft portion 106, slidable with respect to one another to form a telescoping structure. A locking arrangement 108, allows outer shaft portion 106 to be retained in the desired relationship to inner shaft portion 104.

A simple telescoping arrangement is shown for purposes of disclosure. In alternate embodiments, a depressible detent, not shown, may be provided to engage one or more holes, not shown, formed in either inner shaft portion 104 or outer shaft portion 106. Such exemplary locking arrangements are believed to be well known to those of skill in the art and, consequently, are not further described herein. It will be recognized by those of skill in the art that extendable shafts may be formed in other manners. Consequently, the invention is not considered limited to any particular arrangement or mechanism for implementing an extendable shaft. Rather, the invention includes any and all suitable mechanisms for implementing such an extendable shaft.

Further, for purposes of disclosure, inner shaft portion 104 is disposed at the distal end of telescoping shaft 102 while outer shaft portion 106 is disposed at the proximal end thereof. It will be recognized that inner shaft portion 104 and outer shaft portion 106 could easily be reversed. Consequently, the invention covers either arrangement of inner shaft portion 104 and outer shaft portion 106.

In the embodiment chosen for purposes of disclosure, telescoping shaft 102, consisting of inner shaft portion 104 and outer shaft portion 106, is designed to be used only when fully extended. In other words, telescoping shaft 102 may be collapsed for storage, but is not intended to function when in a collapsed configuration. In alternate embodiments, however, telescoping shaft 102 could be designed to be functional when partially extended. The invention, therefore, includes either configuration.

A handle or grip region, 110, is disposed at a proximal end 112 of telescoping shaft 102. A first lever 114 is pivotally attached to handle 110.

First lever 114 is operatively connected to a proximal end of a linkage 116 disposed within elongated, telescoping shaft 102. Linkage 116 may be any flexible elongated element. However, it is desirable that linkage 116 be formed from a material that does not significantly stretch under tension. Typically, linkage 116 is a wire, cable, chain, string, or any other suitable flexible elongated element. Such linkage elements are believed to be known to those of skill in the art and, therefore, are not further described herein. The invention covers any suitable alternate linkage material or mechanism.

First lever 114 is rotatable about a pivot point 118. In the embodiment chosen for purposes of disclosure, linkage 116 is a simple wire disposed within elongated telescoping shaft 102 and linking lever 114 with an actuating and biasing mechanism 128 described in detail hereinbelow.

A cleaning head assembly 120, having a lower cleaning head shaft portion 122 and an upper cleaning head shaft portion 126, is attached to the distal end of elongated shaft 120. A lower elbow joint 124 is disposed between lower cleaning head shaft portion 122 and an upper cleaning head shaft portion 126.

Lower elbow joint 124 may be implemented using a cogwheel, not shown, and a spring-loaded pawl or detent, not shown, interacting therewith. Such mechanisms are believed to be well known to those of skill in the art and, therefore, are not further described herein. The invention comprehends any and all suitable mechanisms for implementing an elbow joint.

Figure 1B:
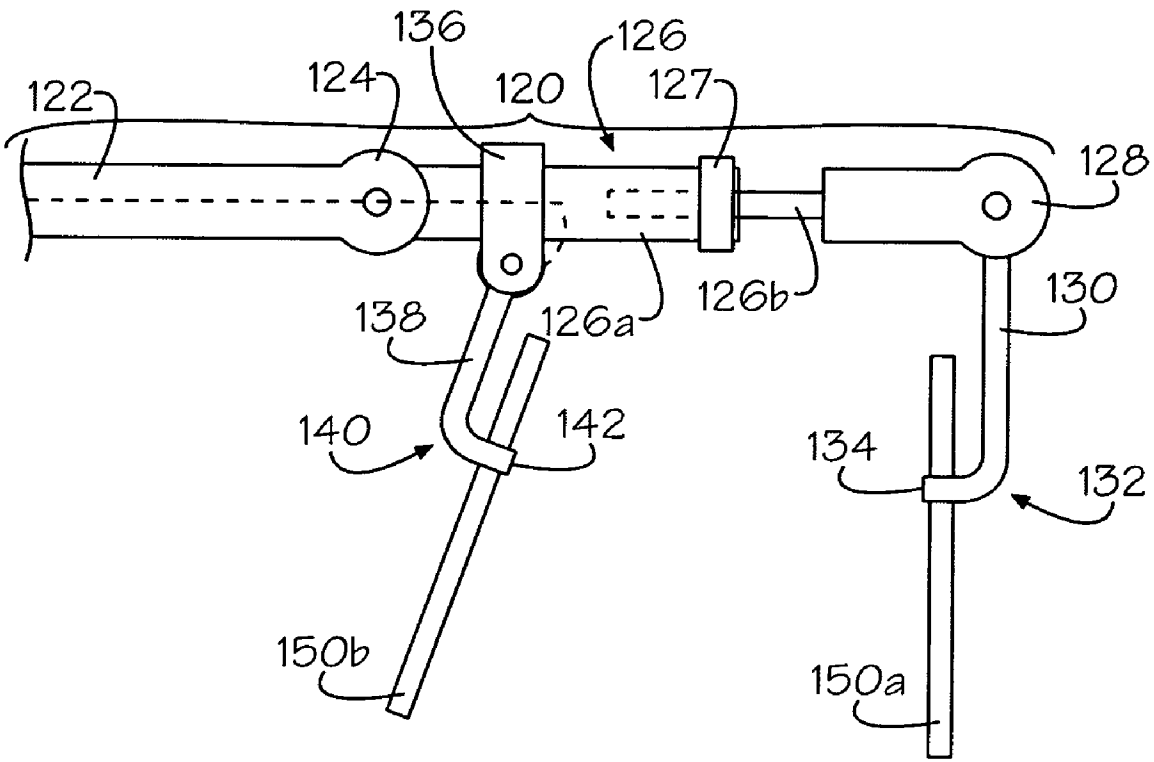
FIG. 1*b* is a detailed, schematic view of the cleaning head portion of the cleaning tool of FIG. 1*a;*

Upper cleaning head shaft 126 may also be implemented as a telescoping assembly. Such a telescoping assembly allows adjustment of the space between upper support arm 130 and lower support arm 138, thereby allowing cleaning tool 100 to be suitably adjusted for a particular cleaning task. Referring now also to FIG. 1*b*, there is shown a detailed schematic view of such a telescoping mechanism. Upper cleaning head shaft 126 consists of two portions, an inner portion 126*b* and an outer portion 126*a*. A second locking arrangement 127 is provided to secure inner portion 126*b* relative to outer portion 126*a*.

An upper elbow joint 128 is disposed at the distal end of upper cleaning head shaft 126. Upper elbow joint 128 is similar to lower elbow joint 124.

An upper support arm 130 is rotatively attached to upper elbow joint 128 and has an approximately 90° bend 132 near its outer, distal end. A U-shaped clasp 134, disposed at the distal end of upper support arm 130, is typically resilient and is adapted to retain a substantially circular cross-section of a fork 150 (FIG. 2) as is described in detail hereinbelow.

A lower support clamp 136 is attached to outer portion 126*a* of upper cleaning head shaft 126 adjacent lower elbow joint 124. Lower support clamp 136 provides pivotal support for lower support arm 138. Lower support arm 138 is substantially identical to upper support arm 130 described hereinabove. Lower support arm 138 includes an approximately 90° bend 140 and a U-shaped clasp 142. It will be recognized that angles other than approximately 90° may readily be implemented to meet a particular operating circumstance or environment and, consequently, the invention includes any angle necessary to properly position upper U-shaped clasp 134 or lower U-shaped clasp 142 of upper arm 130 and/or lower arm 138, respectively.

A distal end of linkage 116 is operatively connected to lower support arm 138, typically near a proximal end thereof, using any suitable connection mechanism. A biasing mechanism, not shown, such as a torsion spring, not shown, may also be included to bias lower support arm 138 downward (i.e., into a more open relationship with upper support arm 130). Suitable attachment and biasing mechanisms are believed to be well known to those of skill in the art and, therefore, are not further described herein.

Figure 2:
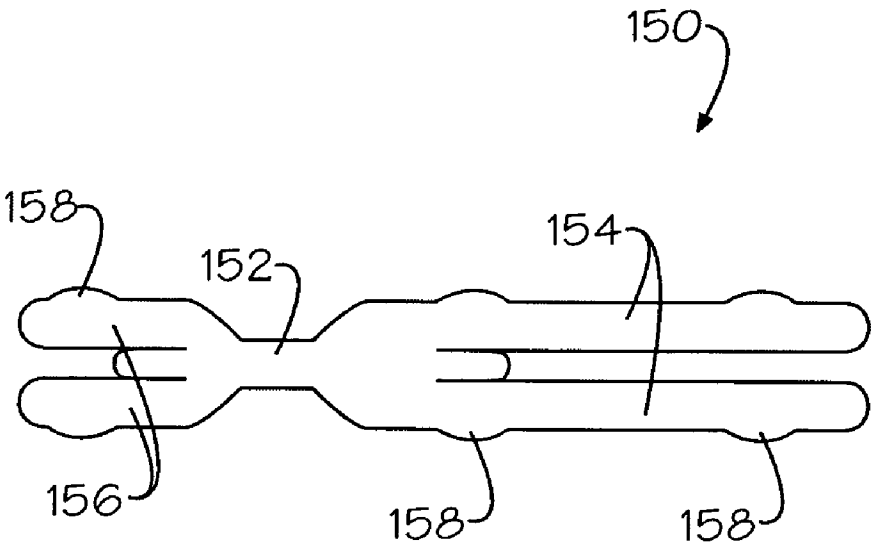
FIG. 2 is a top plan view of a fork assembly for use with the cleaning tool of FIGS. 1*a* and 1*b;*

Referring now also to FIG. 2, there is shown a top plan view of a fork 150. A first fork 150 (designated 150*a*) is typically connected to upper U-shaped clasp 134. A second fork 150 (designated 150*b*) is typically connected to lower U-shaped clasp 142. It will be recognized that because both forks are identical, they may readily be interchanged if and when required. Fork 150 has a cylindrical portion 152 sized and configured for slidable retention in one of upper U-shaped clasp 134 or lower U-shaped clasp 142. Split outer elongated tines 154 extend axially outward away from cylindrical portion 152. Split inner elongated tines 156 extend axially inwardly away from cylindrical portion 152, opposed to outer elongated tines 154. The terms "outward" and "inward" are with reference to the intended function of fork 150 and will become evident as their function is described hereinbelow.

In the embodiment chosen for purposes of disclosure, outer elongated tines 154 are approximately twice as long as inner elongated tines 156. It will also be recognized that this length relationship may be altered to meet a particular operating circumstance or environment. Consequently, the invention covers any relationship between the length of the outer elongated tines 154 and inner elongated tines 156.

Dimples 158 are disposed on both outer elongated tines 154 and inner elongated tines 156. Dimples 158 provide engagement with slot 166 (FIG. 3) of pad 160 (FIG. 3) as is described in detail hereinbelow. While one pair of dimples 158 is shown on inner elongated tines 156 and two pair are shown on outer elongated tines 154, it will be recognized that other numbers and/or configurations of dimples 158 may be provided without deviating from the scope and spirit of the present invention.

Figure 3:
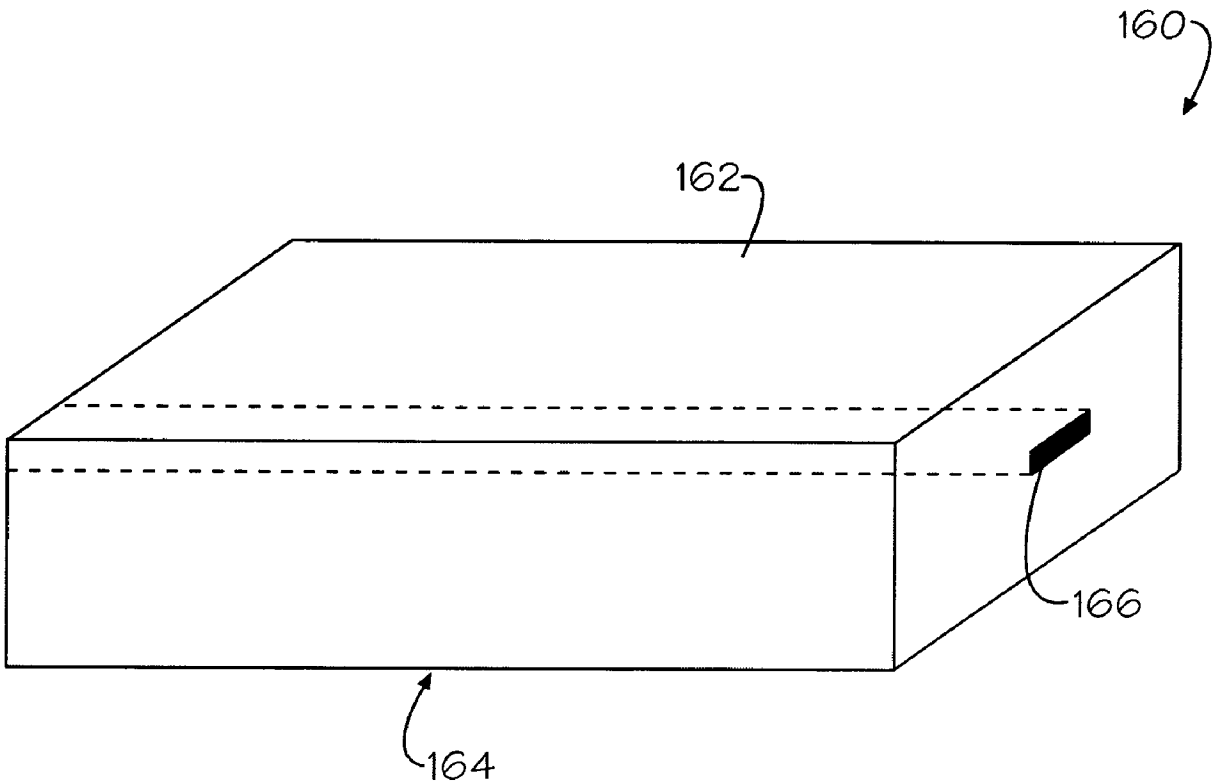
FIG. 3 is a perspective view of a cleaning pad for use with the cleaning tool of FIGS. 1*a* and 1*b;*

Referring now also to FIG. 3, there is shown a side perspective view of a cleaning pad for use with the novel cleaning tool 100 of FIG. 1, generally at reference number 160. Cleaning pad 160 is substantially rectangular and has a first major surface 162 and an opposing major surface 164. A slot 166 is adapted to receive either outer tines 154 or inner tines 156 therein. Dimples 158 interact with inner surfaces, not specifically identified, of slot 166 to frictionally retain pad 160 on selected ones of outer tines 154 or inner tines 156. The length of pad 160 along the major axis of slot 166 is chosen to be approximately the same as the length of outer tines 154. In other words, outer tines 154 may be substantially completely contained within slot 166. However, inner tines 156 only extend approximately to a middle point along the major axis of slot 166. The desirability of this arrangement will be described hereinbelow.

First major surface 162 and second opposing major surface 164 may each be equipped with a different cleaning configuration. For example, major surface 162 of cleaning pad 160 could be an absorbent layer such as a sponge. Opposing major surface 164, on the other hand, could be a dry dusting configuration.

It is envisioned that pad 160 is a symmetrical pad that may be installed in one of four orientations on outer tines 154 or inner tines 156. This selectively allows either major surface 162 or opposing major surface 164 to be oriented as required for a particular cleaning task.

While a substantially rectangular form factor has been chosen for pad 160, it will be recognized by those of skill in the art that other form factors may be substituted therefor. For example, a surface contour designed for a specific cleaning task may be formed on one or both major surfaces of pad 160.

Figure 4:
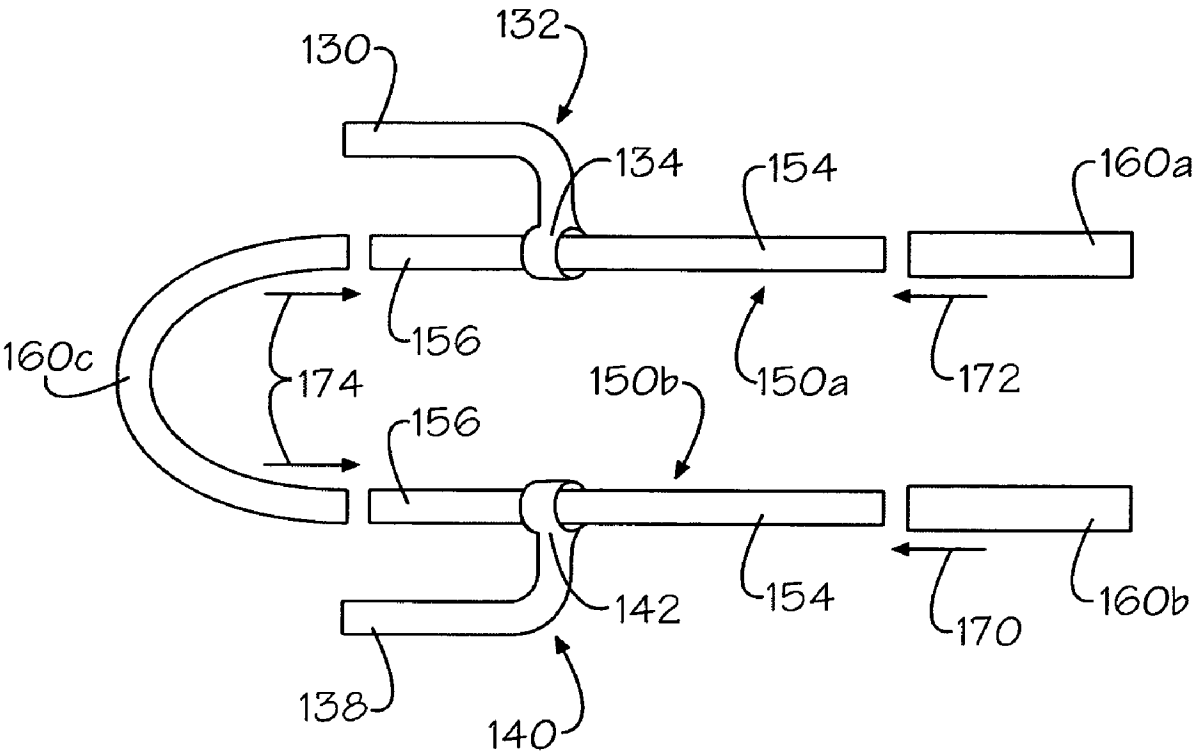
FIG. 4 is a side, elevational, schematic view of the fork assembles of FIG. 2, showing the relationship to the cleaning pads of FIG. 3 in their intended operating positions.

Referring now to FIG. 4, there is shown a side elevational, detailed schematic view showing the relationship of pads 160 and upper and lower forks 150*a*, 150*b*. Three pads 160 are shown. For purposes of illustration, these are designated 160*a*, 160*b*, and 160*c*. Pad 160*a* is disposed for sliding onto outer tines 154 of upper fork 150*a* along arrow 172. Pad 160*b* likewise is disposed for sliding onto outer tines 154 of lower fork 150*b* along arrow 170.

Pad 160*c* is folded, allowing a first end to be slid onto inner tines 156 of upper fork 150*a*, and a second end to be slid onto inner tines 156 of lower fork 150*b* as shown by arrows 174.

Figure 5A:
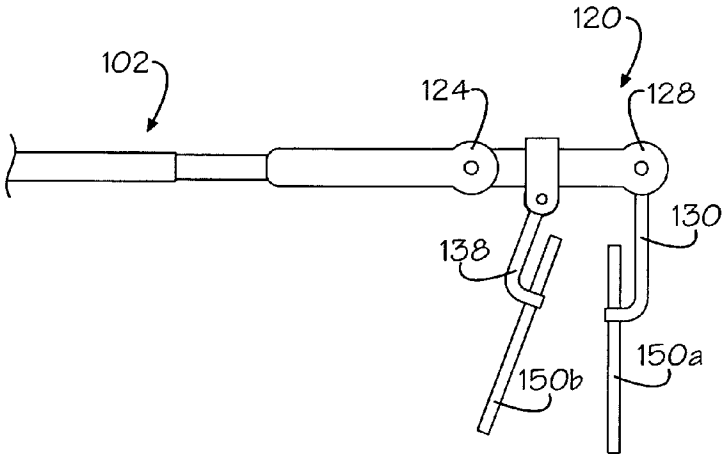
FIGS. 5*a*-5*c* are schematic, plan views of a portion of the tool of FIGS. 1*a* and 1*b*, showing an arm head in three different positions.
Figure 5B:
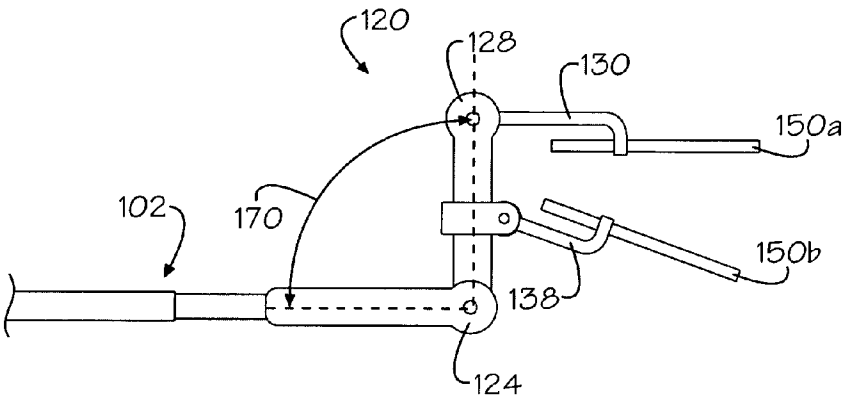
Figure 5C:
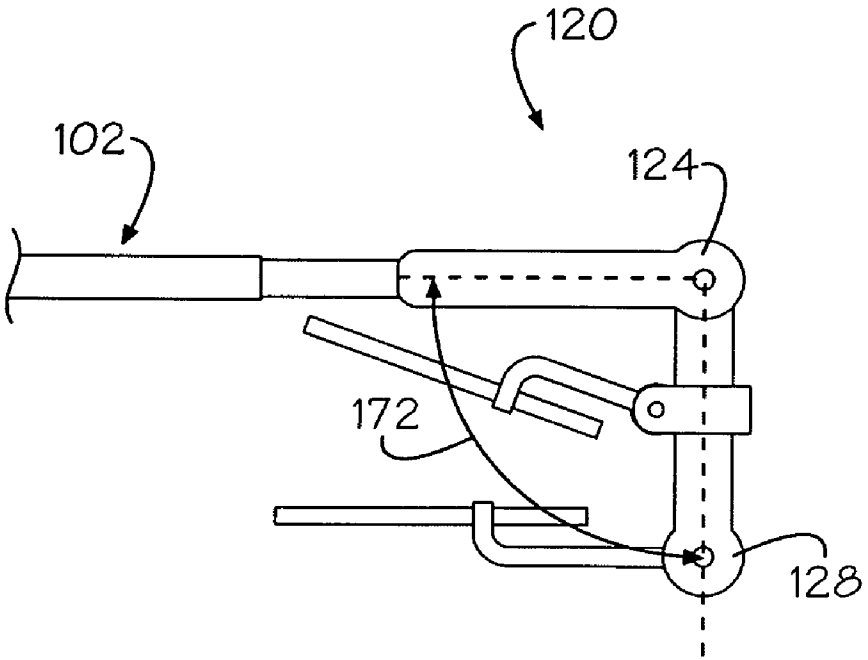

Referring now to FIGS. 5*a*-5*c*, there are shown plan, schematic views of a portion of cleaning tool 100 disposed in different configurations. In FIG. 5*a*, the upper portion of cleaning head 120 is disposed in an unrotated position relative to a major axis of elongated, telescoping shaft 102. In FIG. 5*b*, the upper portion of cleaning head 120 is shown rotated counterclockwise approximately 90° as shown by arrow 170.

In FIG. 5*c*, the upper portion of cleaning head 120 is shown rotated clockwise approximately 90° as shown by arrow 172. Elbow joint 124 may be designed for more than the ±90° rotation relative to elongated, telescoping shaft 102 shown for purposes of disclosure. Consequently, the invention is not limited to ±90° as chosen for purposes of disclosure. Rather, the invention covers any rotational, arcuate movement of the upper portion of cleaning head 120 relative to elbow joint 124.

In still other alternate embodiments, the assembly including elbow joint 124 and arm head 122 may be designed for rotation around a central major axis of elongated, telescoping shaft 102. Mechanisms for implementing such rotation are believed to be well known to those of skill in the art and are not further described herein.

In operation, tool 100 is prepared for use by withdrawing inner shaft portion 104 from its storage position in outer shaft portion 106. Locking arrangement 108 is then used to secure an inner shaft 104 in its extended, operational position.

One or more pads 160, chosen for the cleaning task at hand, are installed on distal ends of outer tines 154 of upper fork 150*a* and/or outer tines 154 of lower fork 150*b*. A third pad 160*c* may be installed on inner tines 156 of upper fork 150*a* and lower fork 150*b* as shown in FIG. 4. One or more of pads 160*a*, 160*b*, 160*c* may be moistened, as required, using water, and an appropriate cleaning solution, or another desired chemical or composition.

Lower support arm 138 supporting fork 150*b* carries a pad 160*b*; upper support arm 130 carries upper supporting arm 150*a* and pad 160*a*. The distance between upper support arm 130 and lower support arm 138 may be adjusted and secured using locking arrangement 127 once inner and outer portions 126*b*, 126*a*, respectively are positioned in a desired relationship. Squeezing lever 114 moves lower support arm 138 towards upper support arm 130, eventually surrounding the object to be cleaned, not shown.

Figure 6:
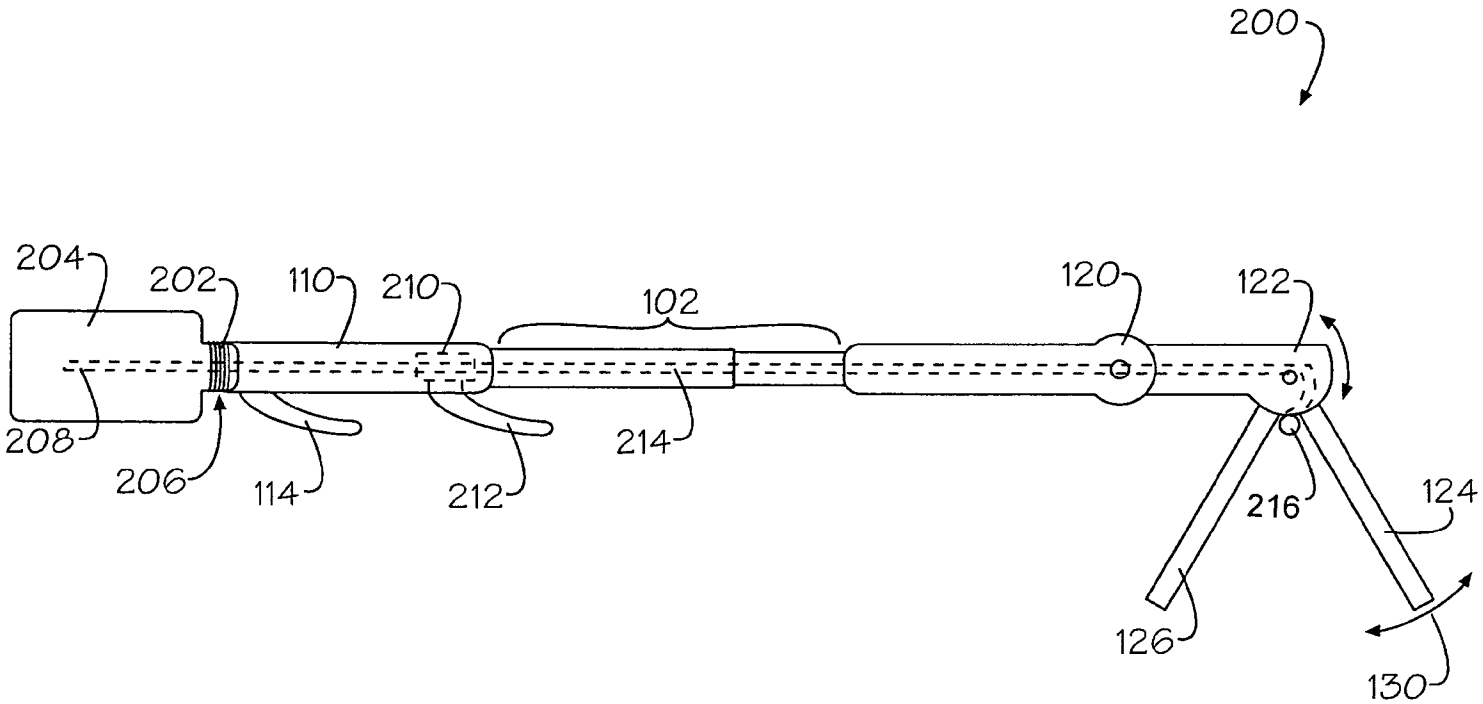
FIG. 6 is a plan, schematic view of an alternate embodiment of the cleaning tool of FIGS. 1*a* and 1*b* containing a detachable fluid reservoir and fluid delivery system.

Referring now to FIG. 6, there is shown a plan, schematic view of a second embodiment of the cleaning tool of the present invention, generally at reference number 200. The distal end of handle 110 is open and equipped with internal threads 202. A bottle 204 has a neck region 206 equipped with external threads, not specifically identified, adapted to mate with internal threads 202. Bottle 204 is threadably attached to handle 110.

A pickup tube 208 projects from the distal end of handle 110 into bottle 204. Pickup tube 208 is routed through an interior region of handle 110 to a pump mechanism 210 also located within handle 110. A second lever 212 is operatively connected to pump mechanism 210. An output tube 214 is connected to pump mechanism 210 and is routed through the interior region of elongated, telescoping shaft 102, through elbow joint 124, into cleaning head 120, where it terminates at a spray head 216.

In operation, squeezing second lever 212 pumps a liquid, not shown, contained in reservoir or bottle 204 through tube 214 into the spray head 216. Spray head 216 may be positioned and configured to moisten faces of pads 160 (FIG. 3) normally mounted on upper support arm 130 and lower support arm 138 via forks 150*b*, 150*a*, respectively. This allows supplying, for example, a cleaning solution to pads 160 while tool 160 is in use.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A cleaning tool, comprising:

a) an elongated shaft having a proximal and a distal end, and comprising a first, inner shaft portion, and a second, outer shaft portion slidably movable with respect to one another;

b) an elbow joint affixed to said distal end of said elongated shaft;

c) a cleaning head movably affixed to said elbow joint and supporting a lower support arm and an upper support arm movable with respect to one another;

d) lower and upper fork assemblies removably attached to a distal end of each of said lower support arm and said upper support arm, respectively, said lower and upper fork assembles each comprising outer tines and inner tines adapted to removably support a cleaning pad thereupon;

e) a first lever rotatively attached to said elongated shaft proximate a proximal end thereof; and f) a linkage operatively connected to said first lever and to said lower support arm disposed to move said lower support arm, responsive to movement of said first lever;

wherein said cleaning head comprises an upper cleaning head shaft disposed between said lower support arm and said upper support arm, said upper cleaning head shaft comprising:

i) an inner portion and an outer portion slidable with respect to one another; and ii) means for locking said inner portion to said outer portion; whereby a distance between said lower support arm and said upper support arm may be adjusted.

2. The cleaning tool as recited in claim 1, further comprising:

g) means for locking said inner shaft portion to said outer shaft portion.

3. The cleaning tool as recited in claim 1, wherein said linkage comprises at least one selected from the group: wire, cable, string, chain, and other flexible elongated element.

4. The cleaning tool as recited in claim 1, further comprising:

g) a pad slidably retained on at least one of said inner tines and said outer tines of at least one of said upper fork assembly and said lower fork assembly.

5. The cleaning tool as recited in claim 4, wherein at least one of said inner tines and said outer tines of at least one of said upper fork assembly and said lower fork assembly comprises a dimple disposed thereupon to facilitate retention of said pad thereupon.

6. The cleaning tool as recited in claim 1, wherein said upper support arm and said lower support arm comprise a U-shaped connecter disposed at their respective distal ends, and each of said fork assemblies comprises a cylindrical portion disposed between said inner tines and said outer tines thereof, said cylindrical portion being sized and configured for receipt and removable retention in said U-shaped connectors.

7. The cleaning tool as recited in claim 6, wherein said cylindrical portions of said fork assemblies are rotatable in said U-shaped connectors around the central axis of said cylindrical portion.

8. A cleaning tool comprising:

a) an elongated shaft having a distal end and a proximal end, and comprising a first, inner shaft portion, and a second, outer shaft portion slidably movable with respect to one another;

b) an elbow joint affixed to a distal end of said elongated shaft;

c) a cleaning head movably affixed to said elbow joint and comprising an upper support arm and a lower support arm movable with respect thereto;

d) a first lever rotatively attached to said elongated shaft proximate a proximal end thereof;

e) a linkage operatively connected to said first lever and to said lower support arm disposed to move said lower support arm with respect to said upper support arm, responsive to movement of said first lever;

f) a fluid reservoir connected to said proximal end of said elongated, extendable shaft;

g) a second lever rotatively attached to said elongated shaft proximate said first lever and operative to pump a liquid from said fluid reservoir;

h) a liquid discharge mechanism disposed at said cleaning head; and i) a conduit disposed between said second lever and said liquid discharge mechanism.

9. The cleaning tool as recited in claim 8, further comprising:

j) means for locking said inner shaft portion to said outer shaft portion.

10. The cleaning tool as recited in claim 8, wherein said linkage comprises at least one selected from the group: wire, cable, string, chain, and other flexible elongated element.

11. The cleaning tool as recited in claim 8, further comprising:

j) a fork assembly removably attached to each of said upper support arm and said lower support arm proximate a distal end thereof, said fork assemblies each having inner tines and outer tines adapted to slidably receive a pad thereupon; and k) at least one pad disposed on at least one of said inner tines and said outer tines of at least one of said lower support arm and said upper support arm.

12. The cleaning tool as recited in claim 11, wherein said upper support arm and said lower support arm comprise a U-shaped connecter disposed at their respective distal ends, and each of said fork assemblies comprises a cylindrical portion disposed between said inner tines and said outer tines thereof, said cylindrical portion being sized and configured for receipt and removable retention in said U-shaped connectors.

13. The cleaning tool as recited in claim 12, wherein said cylindrical portions of said fork assemblies are rotatable in said U-shaped connectors around the central axis of said cylindrical portion.

14. The cleaning tool as recited in claim 11, further comprising:

l) a pad slidably retained on at least one of said inner tines and said outer tines of at least one of said upper fork assembly and said lower fork assembly.

15. The cleaning tool as recited in claim 14, wherein at least one of said inner tines and said outer tines of at least one of said upper fork assembly and said lower fork assembly comprises a dimple disposed thereupon to facilitate retention of said pad thereupon.

* * * * *